United States Patent [19]

Walton et al.

[11] Patent Number: 4,876,979

[45] Date of Patent: Oct. 31, 1989

[54] APPARATUS FOR DEPLOYING AND RECOVERING A SEABORNE VESSEL

[75] Inventors: Jim M. Walton; Arthur E. Munson, both of San Diego, Calif.

[73] Assignee: The United States of America as represented by the Secretary of the Navy, Washington, D.C.

[21] Appl. No.: 142,898

[22] Filed: Jan. 11, 1988

[51] Int. Cl.[4] ..... B63B 21/66

[52] U.S. Cl. ..... 114/258; 114/49; 114/244; 114/253

[58] Field of Search ..... 114/44, 49, 50, 51, 114/52, 53, 54, 244, 248, 249, 250, 258, 259, 260, 261, 262

[56] References Cited

U.S. PATENT DOCUMENTS

| | | | |
|---|---|---|---|
| 372,761 | 11/1887 | Palmer | 114/259 |
| 1,168,040 | 1/1916 | Wick | 114/54 |
| 1,186,889 | 6/1916 | Cowles | 114/51 |
| 1,293,899 | 2/1919 | Pendergast | 114/54 |
| 2,679,224 | 5/1954 | Sturtevant | 114/54 |
| 3,167,103 | 1/1965 | Hawthorne et al. | 114/253 |
| 3,472,191 | 10/1969 | Horton | 114/52 |
| 3,631,829 | 1/1972 | Kamph | 114/259 |
| 3,732,840 | 5/1973 | Dane | 114/249 |
| 3,943,875 | 3/1976 | Sanders | 114/259 |

FOREIGN PATENT DOCUMENTS

| | | | |
|---|---|---|---|
| 2291903 | 6/1976 | France | 114/44 |
| 604742 | 4/1978 | U.S.S.R. | 114/258 |

*Primary Examiner*—Sherman D. Basinger
*Assistant Examiner*—Thomas J. Brahan
*Attorney, Agent, or Firm*—Harvey Fendelman; Thomas Glenn Keough; Michael A. Kagan

[57] ABSTRACT

An apparatus for employing and retrieving a seaborne vehicle having a frangible surface includes a muzzle and a cylindrically shaped cocoon. The muzzle is clamped to the vehicle and then pulled by a rope into the cocoon. Bladders within the cocoon are inflated with pressurized air to retain the vehicle. The vehicle can then be safely retrieved by hoisting the cocoon out of the ocean. Vehicle deployment is achieved by placing the vehicle in the cocoon, pressurizing the bladders with air, lowering the cocoon and attendant vehicle into the ocean, exhausting the air from the bladders, and then towing the cocoon so that water passing through apertures in the bow of the cocoon push the vehicle into the open ocean.

23 Claims, 4 Drawing Sheets

APPARATUS FOR DEPLOYING AND RECOVERING A SEABORNE VESSEL

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The U.S. Navy frequently deploys and retrieves floating vessels that have easily damaged surfaces lacking attachment points. A prime consideration when handling these types of vessels is to ensure that neither the vessel nor its contents are damaged. The conventional method for deploying and retrieving such a vessel utilizes a sling to support the vessel while it is suspended from a ship mounted crane. However, this procedure may subject the vessel to damage from wave action forces generated by rough seas and from passage of the exposed vessel through the interface between the ocean and atmosphere. Damage may also result as the sling responds to rough seas causing the vessel to be slammed against the hull of the ship. Consequently, these activities have been restricted to calm seas. However, the U.S. Navy has a continuing need to launch and retrieve these vessels in rough seas.

SUMMARY OF THE INVENTION

The present invention overcomes these difficulties. It enables deployment and retrieval of frangible vessels in ocean conditions as severe as sea state three or swells up to eight feet with minimal shock transmission to the vessel and its contents. Deployment is accomplished by placing the vessel in a shock attenuating cocoon, transferring the cocoon from the deployment craft into the ocean, and then releasing the vessel from the cocoon freely into the open sea. Vessel recovery is easily and safely achieved by muzzling the vessel, towing it into the cocoon, and then transferring the cocoon to the retrieval craft. The vessel may then be removed from the cocoon on board a ship.

The invention includes a muzzle sized to fit over and grab onto an end of the vessel. A rope attached to the muzzle is threaded through an aperture of a cocoon to recover the vessel in a novel manner. The cocoon is longitudinally split into upper and lower shells having an open end shaped to receive and encapsulate the vessel. Tension applied to the rope by a shipboard winch pulls the muzzle and the attached vessel into the cocoon. Several elongated inflatable bladders mounted parallel to the longitudinal axis of the cocoon against its inside surface are inflated by air pressure to secure the vessel and cushion it. After the vessel has been secured within the cocoon, the cocoon and vessel contained therein can be hoisted on-board the retrieval craft.

Vessel deployment from a ship is easily accomplished by placing the vessel in the lower shell, attaching the upper shell to the lower shell, and then pressurizing the inflatable bladders in the cocoon. The cocoon is next lowered into the sea. Pressure in the inflatable bladders is relieved while the cocoon is towed behind the ship. Important features of the cocoon are apertures in the bow through which passing water impinges upon the vessel to push it out into the sea.

OBJECTS OF THE INVENTION

An object of the invention is to provide an apparatus for shipboard deployment of a vessel.

A second object of the invention is to provide an apparatus for shipboard retrieval of a seaborne vessel.

A third object of the invention is to provide an apparatus to safely transfer a vessel between the ocean and a ship.

These and other objects of the invention will become more readily apparent from the ensuing specification and claims when taken in conjunction with the attached drawings.

DESCRIPTION OF THE PREFERRED EMBODIMENT

Figure 1:
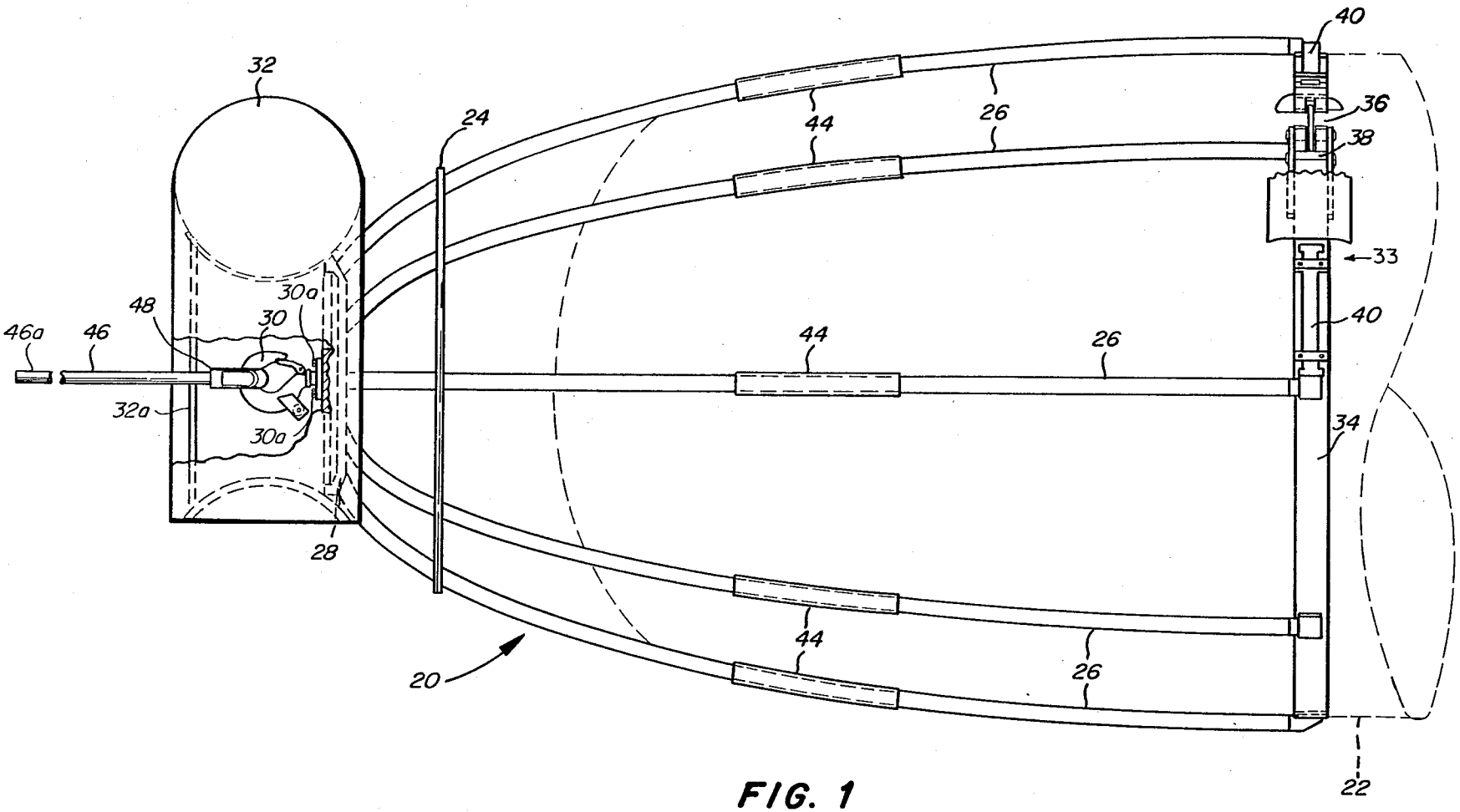
FIG. 1 is an elevation view of the muzzle.
Figure 2:
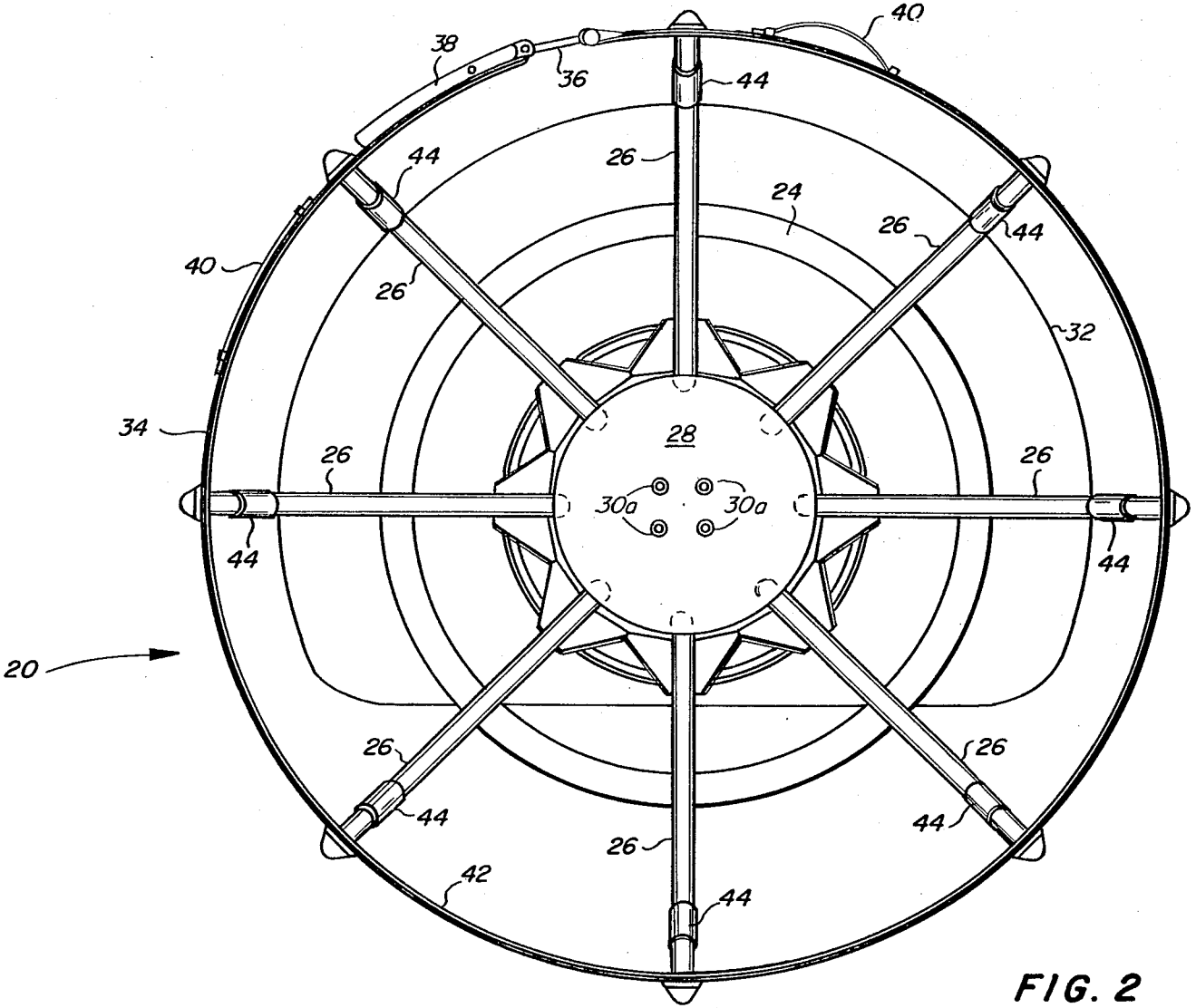
FIG. 2 is a view looking into the open end of the muzzle.

Referring now to the drawings, wherein like reference numerals designate like or similar parts throughout the several views, there is illustrated in FIGS. 1 and 2 a novel muzzle 20 for obtaining secure control of an ocean borne floatable vessel 22, illustrated in phantom, having a frangible surface. The muzzle may include a frame 24 configured in the shape of a truncated ellipsoid formed by eight longitudinal tubular spars 26 which converge at nose plate 28. Tow hook 30 is mounted to nose plate 28 by bolts 30*a*. Air filled lift tube 32 shaped as an irregular annulus is supported by a ring shaped framed 32*a* which is lashed to frame 24. Lift tube 32 provides buoyancy to muzzle 20. Tow hook 30 extends through a circular opening, not shown, of lift tube 32 and frame 32*a*. The open end 33 of muzzle 20 opposite nose plate 28 is defined by annular split band 34 which forms a circular opening shaped to receive the vessel. Band 34 has a split opening 36 enabling band 34 to be selectively tightened around vessel 22 by toggle clamp 38 mounted on band 34 that bridges split opening 36. Straps 40 affixed to the exterior of band 34 facilitate manual handling of muzzle 20. Silicone rubber liner 42 is attached as by epoxy cementing it to the inside surface of band 34 to prevent damaging vessel 22 and provides a frictional surface to retain vessel 22 when band 34 is tightened. Sections of silicon rubber hose 44 mounted approximately halfway along the lengths of each tubular spar 26 of frame 24 prevent spars 26 from damaging the surface of vessel 22. Nylon rope 46 is threaded through tow hook 30 via plastic rope thimble 48. Rope end 46*a* of rope 46 is left free in the ocean to be used as will be discussed herein.

Figure 3:
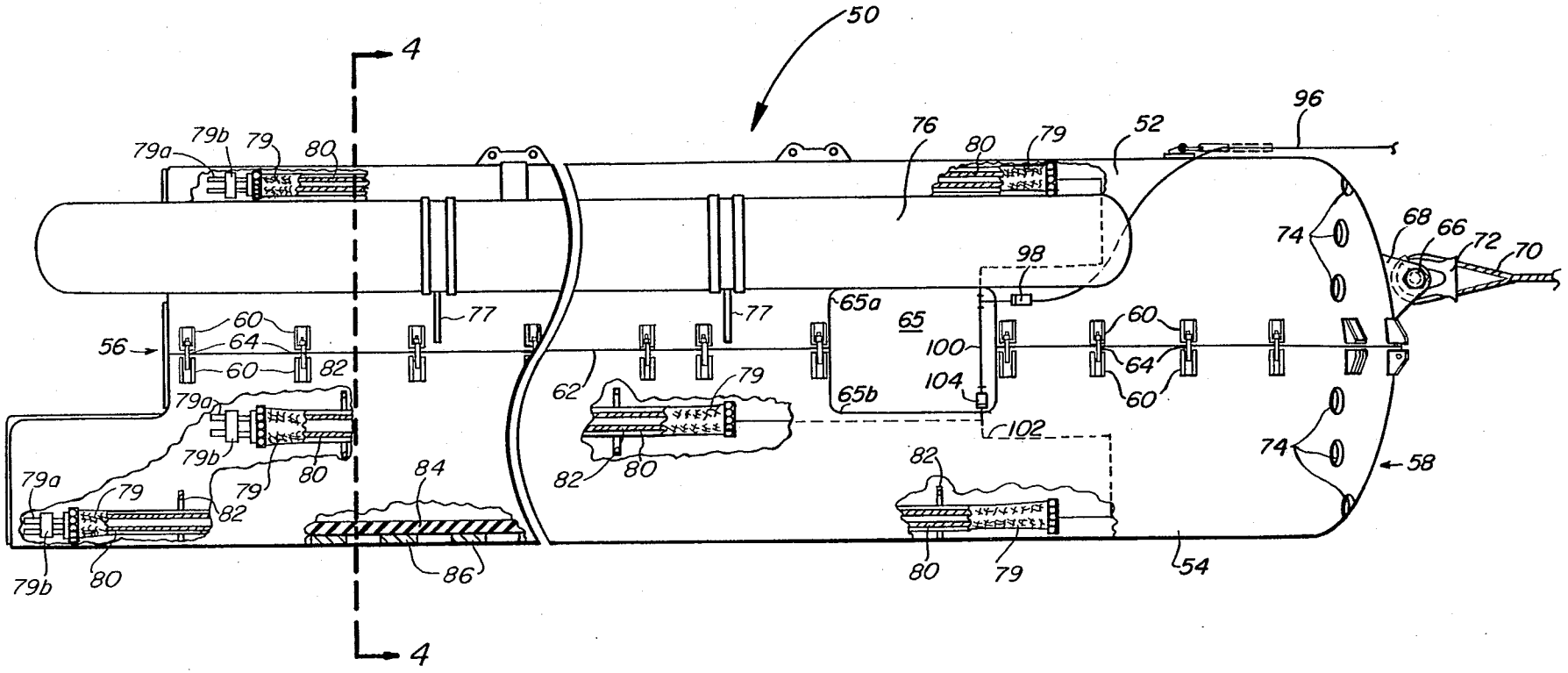
FIG. 3 is a partially cutaway, elevation view of the cocoon.

A cocoon 50, depicted in FIG. 3 may be configured as a blunt nosed, hollow cylindrical body, longitudinally split into an upper shell 52 and lower shell 54. Cocoon 50 is open to the sea at its stern 56 and substantially closed at its bow 58. A plurality of brackets 60 are welded to the outside surfaces of shells 52 and 54 adjacent to longitudinal split 62 where shells 52 and 54 mate so that each bracket 60 on upper shell 52 aligns with a bracket 60 on lower shell 54 when shells 52 and 54 are fitted together. Threaded fasteners 64 are fitted through aligned brackets 60 and when tightened hold shells 52 and 54 together. Cutout areas 65 formed by slots 65*a* and 65*b* in both sides of upper and lower shells, 52 and 54 respectively, provide access while the vessel is encapsulated within the cocoon to equipment which may be mounted on the vessel surface. Pin 66 is pivotally mounted in bow bracket 68 welded to bow 58 of cocoon 50. Nylon rope 70 is threaded through rope thimble 72 pivotally constrained by pin 66 so that cocoon 50 can be towed to and hoisted aboard the retrieval craft.

Figure 4:
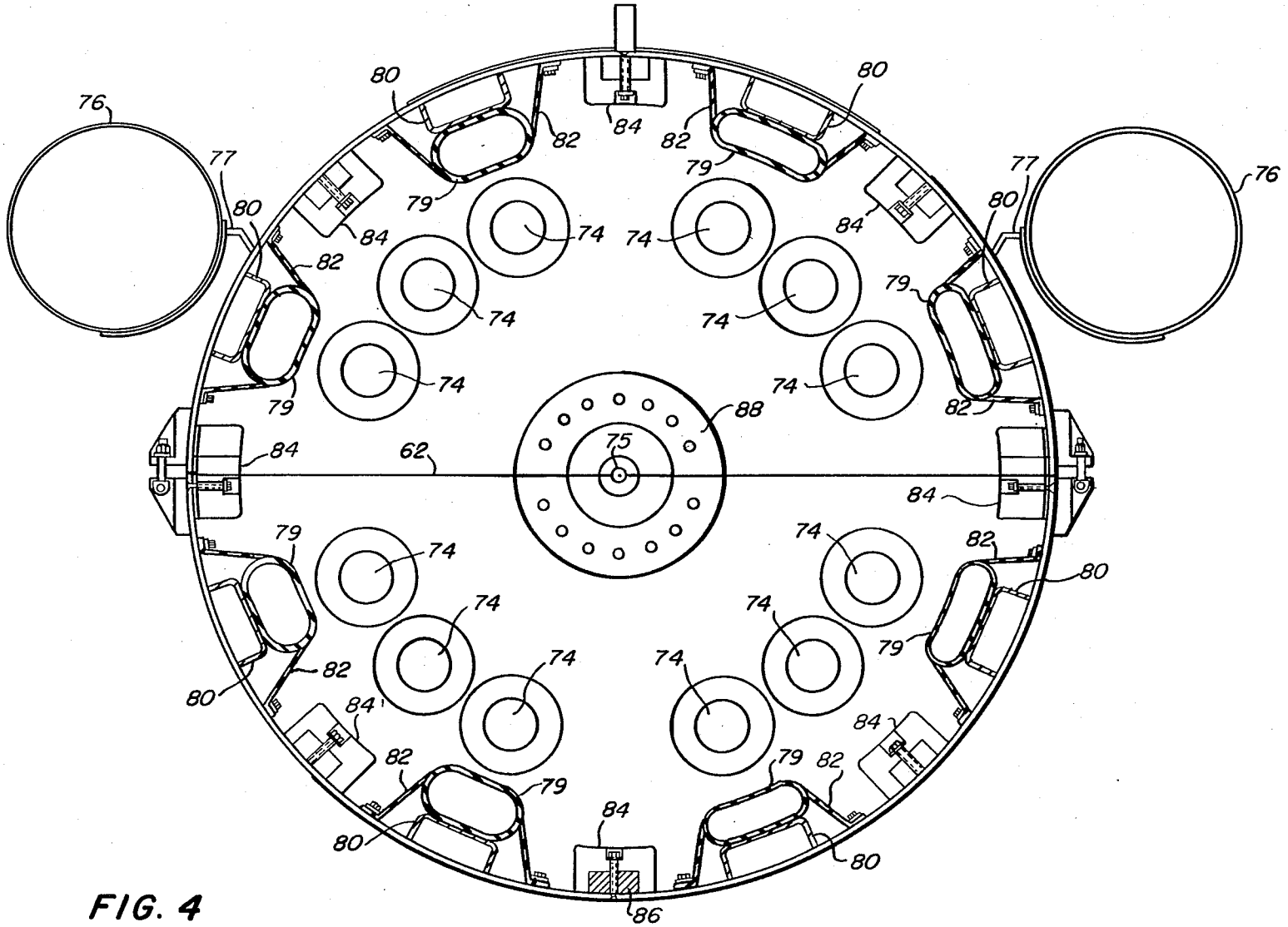
FIG. 4 is a cross-sectional interior bow view of the cocoon.

A plurality of apertures 74 in bow 58, as shown in FIG. 4 allow water to pass through bow 58 while cocoon 50 is being towed. The passing water impinges upon vessel 22 and pushes it out of cocoon 50 freely into the open sea. Bow 58 also has an aperture 75 through which the free end 46*a* of rope 46 is threaded so that muzzle 20 and attached vessel 22 can be towed into cocoon 50. Two flotation tanks 76 mounted by brackets 77 to upper shell 52 provide buoyancy to cocoon 50.

Referring to FIGS. 3 and 4, inflatable bladders 79 extending the substantial length of cocoon 50 may be selectively inflated with air pressure to snugly retain and cushion vessel 22 within cocoon 50. When deflated, bladders 79 provide an open area sufficient to enable vessel 22 to pass through stern 56 of cocoon 50. Bladders 79 may be a plurality of elongated, resilient inflatable hoses 79. The end of each hose 79 nearest stern 56 is suspended by compression spring mount 79*a* mounted in support block 79*b*. Support blocks 79*b* are mounted to the interior surfaces of upper shell 52 and lower shell 54. Compression spring mounts 79*a* accommodate volumetric dimensional changes of hoses 79 when inflated or depressurized. The ends of hoses 79 nearest bow 58 are mounted to the interior surfaces of upper shell 52 and lower shell 54. A plurality of elastic straps 82 fastened to the interior surface of cocoon 50 resiliently hold each inflatable hose 79 against a channel 80 welded to and radially distributed around the interior surface of cocoon 50. Still referring to FIG's. 3 and 4, a plurality of longitudinal, "C"-shaped rubber bumpers 84 radially mounted about the interior surface of cocoon 50 extend the substantial length of cocoon 50 and act as guides during transfer of vessel 22 to and from cocoon 50. A plurality of lead weights 86 may be mounted within the space formed by surrounding rubber bumpers 84 and distributed the substantial length of cocoon 50. Lead weights 86 establish net buoyancy of cocoon 50 so that the longitudinal center axis of cocoon 50 when deployed coincides with the longitudinal center axis of floating vessel 22. Rubber bumper 88 mounted inside bow 58 of cocoon 50 protects vessel 22 from abrasion damage from bow 58 and cushions muzzle 20 and vessel 22 from docking impact forces while muzzle 20 and vessel 22 are towed into cocoon 50.

Returning to FIG. 3, an air supply hose 96 from the ship snaps into a first quick disconnect fitting 98 to provide pressurized air to upper shell pneumatic system 100 which is in gas communication with lower shell pneumatic system 102 via second quick disconnect fitting 104. Gas communication in pneumatic systems 100 and 102 may be accomplished through pneumatic hose or stainless steel tube. Pressurized air is distributed to inflate hoses 79 and exhausted to deflate them through pneumatic systems 100 and 102 by suitable means on board the ship as would be readily understood by one of ordinary skill in this art.

Operation of the Invention

In the operation of the invention for deployment of a seaborne vessel 22 having a frangible surface from a ship, threaded fasteners 64 are loosened so that upper shell 52 can be separated from lower shell 54. Vessel 22 is then placed onto lower shell 54. Upper shell 52 is fitted and reattached onto lower shell 52 to form cocoon 50 by tightening threaded fasteners 64. Air pressure supplied by suitable means on board ship to cocoon 50 through pneumatic hose 96 to upper shell pneumatic system 100 and lower shell pneumatic system 102 pressurizes inflatable hoses 79 which inflate to snugly engage and cushion vessel 22.

After vessel 22 is secured, cocoon 50 is lowered by rope 70 into the sea by suitable means, such as by a crane located on board the ship. Once in the sea, air pressure in inflatable hoses 79 is relieved by suitable means on board the ship as would be readily understood by one skilled in this art. Cocoon 50 is towed by rope 70 at approximately 3 to 5 knots so that water flowing through apertures 74 in bow 58 impinges upon vessel 22 to push it out into the open sea through stern 56 of cocoon 50. Vessel 22 is then free to perform its operational purposes during which time cocoon 50 and muzzle 20 may be brought on board ship.

When desired to recover vessel 22, cocoon 50 and muzzle 20 are placed in the ocean in the vicinity of vessel 22 with upper and lower shells 52 and 54, respectively, fastened together. At this stage, air pressure in inflatable hoses 79 is 0 psig so that hoses 79 are not inflated. End 46*a* of rope 46 is threaded through stern 56 of cocoon 50 and on through aperture 75 in bow 58 of cocoon 50. Divers place muzzle 20 over one end of vessel 22 and frictionally engage it with toggle clamp 38. Rope 46 is pulled by suitable means such as by a winch located on board the ship to draw muzzle 20 and vessel 22 into cocoon 50. Once in cocoon 50, inflatable hoses 9 are pressurized by suitable means located on board ship as would be readily understood by one skilled in the art through pneumatic hose 96 and pneumatic systems 100 and 102 to snugly engage vessel 22. Rope 46 is slackened. Cocoon 50 may then be hoisted by rope 70 on board the ship by suitable means such as by a crane without risk of damaging the vessel or its contents. Then, inflatable hoses 79 are depressurized and upper shell 52 is separated from lower shell 54. Vessel 22 may then be lifted out of lower shell 54 followed by removal of muzzle 20 from vessel 22.

Obviously, many modifications and variations of the present invention are possible in the light of the above teachings. It is therefore to be understood that within the scope of the appended claims the invention may be practiced otherwise than as specifically described.

We claim:

1. An apparatus for shipboard deployment and recovery of a seaborne vessel, comprising:

muzzle means for selectively gripping the exterior of the vessel and retaining the vessel so that the vessel may be towed;

cocoon means having a hollow interior, a bow end, and a stern end, the stern end being open for receiving the muzzle means and attached vessel into the interior of the cocoon;

first tensile means connected to the muzzle means, the tensile means being threaded through the aperture in the bow end of the cocoon for towing the muzzle and vessel retained therein in the cocoon; and second tensile means connected to the cocoon for towing the cocoon; and inflatable resilient bladder means mounted in the interior of the cocoon for snugly engaging and retaining the vessel within the cocoon and for providing the vessel with shock attenuation protection upon introduction of pressurized fluid therein.

2. The apparatus of claim 1 wherein the bladder means includes:

a plurality of flexible hoses; and conduit means mounted to the cocoon, the conduit means being connected to the flexible hoses for providing fluid communication to each flexible hose.

3. The apparatus of claim 2 wherein:

the muzzle means has an open end capable of receiving the vessel.

4. The apparatus of claim 3 wherein:

the first tensile means is a rope; and the second tensile means is a rope.

5. The apparatus of claim 4 wherein:

the cocoon is positively buoyant; and the muzzle means is positively buoyant.

6. The apparatus of claim 5 wherein:

the cocoon is longitudinally split into a lower shell and an upper shell; and the cocoon further includes:

fastening means mounted to each shell for attaching the shells together.

7. The apparatus of claim 6 wherein the muzzle means includes:

a frame shaped as a truncated ellipsoid formed by tubular spars.

8. The apparatus of claim 7 wherein the frame includes:

a split circular band forming the perimeter of the open end, the band having a gripping surface for frictionally engaging the vessel; and clamp means mounted on the split band for selectively engaging the gripping surface to secure the vehicle within the muzzle.

9. The apparatus of claim 8 which further includes:

first buoyant support means mounted to the cocoon for providing positive buoyancy to the cocoon; and second buoyant support means mounted to the muzzle for providing positive buoyancy to the muzzle.

10. The apparatus of claim 9 wherein:

the first buoyant support means includes at least one floatation tank; and the second buoyant support means is an air filled lift bag.

11. The apparatus of claim 10 wherein the fastening means includes:

a first plurality of brackets mounted to the lower shell;

a second plurality of brackets mounted to the upper shell; and a plurality of threaded fasteners for engaging the first and second plurality of brackets such that the upper shell and lower shells may be attached together.

12. The apparatus of claim 11 wherein the cocoon includes:

a plurality of resilient bumpers mounted within the interior of the cocoon that define an open envelope greater than the cross-sectional area of the vessel and smaller than the open envelope formed by the deflated bladder means to cushion and guide the vessel while transferring from within and without the cocoon.

13. The apparatus of claim 12 wherein:

the clamp means is a toggle clamp.

14. The apparatus of claim 13 wherein the cocoon includes:

a plurality of weights mounted to the cocoon to establish net buoyancy of the cocoon.

15. An apparatus comprising:

cocoon means for providing shock attenuation to a vessel being transferred between the ocean and a ship, the cocoon means having a hollow interior, a bow end, and a stern end, the bow end having at least one aperture, the stern end being open to permit transfer of the vessel between the ocean and the interior of the cocoon so that the cocoon may selectively encapsulate the vessel, the cocoon being shaped as a hollow cylinder longitudinally split into a lower shell and an upper shell;

resilient bladder means mounted in the interior of the cocoon selectively inflated upon introduction of pressurized fluid therein for snugly retaining the vessel and for providing the vessel with shock attenuation protection while the vessel is within the cocoon;

a plurality of flexible hoses;

conduit means mounted to the cocoon, the conduit means being connected to the flexible hoses for providing fluid communication to each flexible hose; and fastening means mounted to each shell for attaching the shells together.

16. The apparatus of claim 15 wherein the cocoon includes:

floatable support means mounted to the cocoon for providing positive buoyancy to the cocoon; and tensile means mounted to the cocoon for transferring the cocoon between the ocean and the ship.

17. The apparatus of claim 16 wherein:

the floatable support means includes at least one floatation tank; and the tensile means is a rope.

18. The apparatus of claim 17 wherein the cocoon includes:

a plurality of resilient bumpers mounted within the interior of the cocoon that define an open envelope greater than the cross-sectional area of the vessel and smaller than the open envelope formed by the deflated bladder means to cushion and guide the vessel while the vessel is being transferred between the ocean and the interior of the cocoon.

19. The apparatus of claim 18 wherein the cocoon includes:

a plurality of weights mounted to the cocoon to establish net buoyancy of the cocoon.

20. An apparatus for engaging a seaborne vessel that the apparatus and engaged vessel may be towed to recover the vessel, comprising:

muzzle means for selectively gripping the exterior of the vessel and retaining the vessel so that the vessel may be relocated by exerting force on the muzzle, the muzzle means having an open end capable of receiving the vessel, the muzzle means having a frame shaped as a truncated ellipsoid formed by tubular spars, the muzzle means being positively buoyant;

tensile means connected to the muzzle means for towing the muzzle means and vessel retained therein;

a split circular band mounted to the frame, the band forming the perimeter of the open end;

clamp means mounted on the split band for selectively and frictionally retaining the vehicle within the muzzle;

buoyant support means mounted to the muzzle means for providing buoyancy to the muzzle means.

21. The apparatus of claim 20 wherein:

the clamp means is a toggle clamp;

the buoyant support means is an air filled lift bag having a closed volume; and the tensile means is a rope.

22. A method for retrieving a seaborne vessel comprising the steps of:

selectively engaging the vessel by placing a muzzle over an end of the vessel and frictionally attaching the muzzle to the surface of the vessel;

transferring the vessel into a seaborne cocoon by towing the muzzle and the vessel secured therewith into the cocoon;

snugly securing the vessel within the cocoon by inflating a plurality of inflatable bladders mounted within the cocoon with pressurized fluid to snugly engage the vessel; and retrieving the cocoon by hoisting the cocoon containing the vehicle out of the sea.

23. The method as recited in claim 22 wherein the step of expanding the inflatable bladders includes:

pressuring the bladders with air.

* * * * *